United States Patent [19]

Bione

[11] 4,306,481

[45] Dec. 22, 1981

[54] DYNAMIC ONE FINGER CHORDING SYSTEM

[75] Inventor: Angelo A. Bione, Chicago, Ill.

[73] Assignee: Marmon Company, Chicago, Ill.

[21] Appl. No.: 804,810

[22] Filed: Jun. 8, 1977

[51] Int. Cl.[3] ..... G10F 1/00

[52] U.S. Cl. ..... 84/1.03; 84/DIG. 22

[58] Field of Search ..... 84/1.01, 1.03, 1.17, 84/1.24, DIG. 22, DIG. 23, DIG. 8

[56] References Cited

U.S. PATENT DOCUMENTS

| | | | |
|---|---|---|---|
| 3,359,358 | 12/1967 | Brand et al. | 84/1.01 |
| 3,590,129 | 1/1971 | Freeman | 84/1.01 |
| 3,629,481 | 12/1971 | Bunger | 84/1.03 |
| 3,665,088 | 5/1972 | Brand et al. | 84/1.01 |
| 3,681,508 | 8/1972 | Bohm | 84/1.03 |
| 3,706,837 | 12/1972 | Arsem et al. | 84/1.03 |
| 3,708,604 | 1/1973 | Hebeisen et al. | 84/1.03 |
| 3,740,449 | 6/1973 | Southard | 84/1.01 |
| 3,918,341 | 11/1975 | Bunger | 84/DIG. 22 |
| 3,941,024 | 3/1976 | Brand et al. | 84/DIG. 22 |
| 4,000,674 | 1/1977 | Schreier | 84/DIG. 22 |
| 4,019,417 | 4/1977 | Carlson | 84/DIG. 22 |
| 4,022,098 | 5/1977 | Deutsch | 84/1.03 |
| 4,055,103 | 10/1977 | Machanian | 84/DIG. 22 |
| 4,065,993 | 1/1978 | Hirose | 84/DIG. 22 |
| 4,083,283 | 4/1978 | Hiyoshi et al. | 84/1.26 |
| 4,108,037 | 8/1978 | Robinson et al. | 84/1.03 |

*Primary Examiner*—J. V. Truhe
*Assistant Examiner*—Forester W. Isen
*Attorney, Agent, or Firm*—Neuman, Williams, Anderson & Olson

[57] ABSTRACT

A dynamic one finger chording system with memory is connected in parallel relationship to the d.c. keying lines connecting a select number of keys of the manual to a standard keyer circuit of an electronic organ. The one finger chording system scans each keying line until a line with a d.c. level voltage signal corresponding to a manually depressed key is detected. An identification of the detected line is used as the address to a read only memory. In response to the address, the read only memory provides a preselected d.c. level output signal which through appropriate output circuits drives respective keying lines. Thus one keying line has a d.c. level signal due to the manual depression of a key and a predetermined number of keying lines have a d.c. level signal due to the output signal from the one finger chording read only memory. The same keyer circuit that is used during normal playing now provides a chord output signal. When the key is released by the instrument player, the one finger chording system begins to scan the keying lines for the next key depressed. If a new key is depressed without releasing the previously depressed key, the one finger chording system removes itself from the respective keying line of the previously depressed key before beginning the scan for the new keying line with a d.c. level signal. Furthermore, upon depression of a key the system receives a load pulse of finite duration which momentarily disables the scanning and clears the one finger read only memory output so that when the scanning is resumed for the new d.c. level signal it is not confused by the previous d.c. level signal output from the read only memory. The one finger chording system has a memory mode actuatable by the instrument player and which electrically sustains the selected one finger chord after the instrument player releases the depressed key and until a new key is depressed or the memory feature deactivated.

36 Claims, 7 Drawing Figures

DYNAMIC ONE FINGER CHORDING SYSTEM

BACKGROUND OF THE INVENTION

1. Field of the Invention

This invention relates to electronic musical instruments and in particular to electronic organs and features thereof, namely one finger chording devices. The one finger chording system enables the instrument player, by depressing any one of a select group of keys on the manual of an electronic organ, to play a preselected chord corresponding to the depressed key.

While the present invention is described herein with reference to particular embodiments, it should be understood that the invention is not limited hereto. The one finger chording system of the present invention may be employed in a varity of forms, as one skilled in the art will recognize in light of the present disclosure.

2. Prior Art

One finger chording devices are well-known in the electronic organ industry as illustrated by U.S. Pat. Nos. 3,359,358, 3,629,481; 3,681,508; and 3,708,604. A frequent drawback or problem with one finger chording systems in common use is the necessity of using separate keyer circuits for producing chords played in the standard manner and chords played by the one finger system. In addition to the added cost of using separate keyer circuits, the different keyer circuits provide a different tonal quality output signal. This fact renders the chords played in a conventional manner different sounding than chords played in the one finger system. Even a slight variation in the audio output is disconcerting and bothersome to the listener and instrument player.

Another approach to one finger chording systems has been to use multiple key contacts associated with the keys on the lower manual of a two manual organ adapted to operate in the one finger chording mode. The additional key contact approach to one finger chording entails additional manufacturing and assembly cost in addition to the cost of multiple key contacts.

Another difficulty with the static one finger chording systems of the prior art occurs if two or more keys are depressed. In this situation, the chords associated with each depressed key is played. These static one finger chording systems are not selective between a prior key depression and a new key depression. Many organists are taught to play the organ based upon the principle that one key should not be released until a new key is depressed. In practice, this playing technique prevents breaks in the audio output due to the lack of a natural mechanical sustain of the musical note as is found in the conventional piano mechanism. An instrument player who follows the above technique cannot effectively use the static one finger systems since the coincidental depression of two keys results in the playing of two chords.

It is therefore a general object of this invention to overcome the problems of such prior art devices.

Another object is to provide a dynamic one finger chording system which is connected in parallel to the d.c. keying lines between associated keys on the lower manual and conventional keyer circuits of an electronic organ.

Another object is to provide a dynamic one finger chording system which does not require multiple key contacts.

Another object is to provide a dynamic one finger chording system which uses the same keyer circuits to provide the one finger chords as are used in conventional playing.

Another object is to provide a dynamic one finger chording system which continuously scans the d.c. keying lines to detect the presence of a d.c. level signal and subsequently provides correspondng signals to the keyer circuit to play a selected chord.

Another object is to provide a dynamic one finger chording system which plays a single chord regardless of the number of keys depressed and always plays a new one finger chord upon the depression of new key.

Yet another object is to provide a dynamic one finger chording system with a memory to sustain the chord output after the instrument player releases the depressed key.

Other objects will be apparent from the following summary and detailed description.

SUMMARY OF THE INVENTION

The present invention is directed to a dynamic one finger chording system for use in an electronic organ. The one finger chording system is connected in parallel across the d.c. keying lines between a select number of keys on the lower manual of a two manual organ and the conventional keyer circuit. Thus, the same key contacts and the same keyer circuit that are used in conventional playing are used when operating in the one finger chording mode. When the one finger chording system is on and the instrument player depresses one of the associated keys on the lower manual, a d.c. level voltage signal is placed upon a d.c. keying line corresponding to the depressed key. The d.c. keying lines are, of course, connected to a standard d.c. keyer system to produce corresponding audio frequency output signals. Since the one finger chording system is connected in parallel relationship to the keying lines, the d.c. level signal corresponding to the depressed key is received by the one finger chording system. In the preferred embodiment the one finger chording system is made on a MOS integrated circuit. However, it should be apparent that the same circuit can be constructed from discrete circuit components.

The one finger chording system is a dynamic scanning system which continuously scans the keying lines in an attempt to detect a line with a d.c. level signal. An input multiplexer receives the d.c. keying lines as inputs and is addressed by a binary counter. The counter is only disabled by a logic control circuit under two circumstances, first, upon receipt of a load pulse by the control circuit from a legato circuit which indicates that a key has been depressed by the instrument player; and, second, upon finding a keying line with a d.c. level voltage. As the counter steps through its binary output sequence, the multiplexer scans each d.c. keying line. Once a keying line with a d.c. level signal is detected, the counter is disabled and remains disabled as long as the instrument player retains the key depressed and due to the operation of the remainder of the system the keyer circuit provides a musical chord output. Upon release of the depressed key by the instrument player, the counter begins to sequence, the scanning of the keying lines resumes and the musical chord output from the keyer circuit ceases.

The instrument player during normal playing may depress one key and retain it down while at the same instant depressing a second key. In this situation, the first key down places a d.c. level voltage on the d.c. keying line and the scanning and counting circuits locate this d.c. keying line. If when the second key is depressed, the counter, which has not yet begun to sequence due to the first key remaining depressed, considers the d.c. level signal on the line of the first key depressed, the same chord would be sounded even though a new one finger key is depressed. To prevent the occurrence of this undesirable situation, the control circuit of the present invention produces a short duration pulse output at the termination of the load pulse and this short duration pulse causes the counter to step once. The counter thereby is forced to move to a new position even though a prior detected d.c. keying line has not been released. The scanning operation begins and detects the second key down as indicated by the d.c. level voltage on the keying line associated with the second key and a new chord is sounded due to the operation of the remainder of the system.

Once the scanning portion of the one finger chording system detects the keying line with a d.c. level voltage, a one finger matrix is enabled by a logic control circuit and is addressed with information from the binary counter corresponding to which d.c. keying line is detected. The one finger matrix is preprogramed to produce a d.c. level output signal on selected ones of a plurality of output lines depending upon the d.c. keying line detected. The output of the one finger matrix is connected to a buffer output circuit which drives the keying lines which correspond to the output lines of the one finger matrix so that a predetermined chord is produced by the d.c. keyer circuit. The buffer circuit is connected to the d.c. keying lines over the same lines which connect the keying lines to the multiplexer. The d.c. level signal from the one finger matrix is put on the d.c. keying line via these bidirectional connections. Therefore, the same d.c. keyer circuit which responds to normal playing also responds to the one finger chord playing. This reduces the number of components especially keyer circuits necessary and assures compatible audio sound reproductions. Since these lines are bidirectional, each load pulse from the legato detector disables the one finger matrix output so that the signal received by the multiplexer originates from key depression at the lower manual and not from the one finger matrix.

The dynamic one finger chording system has a memory mode of operation. The output lines of the buffer circuit as well as the input lines to the multiplexer are connected to a latching circuit. The instrument player selects the memory mode of operation by closing a switch on the organ console. The switch closure enables the latching circuit which operates as a positive feedback to the buffer circuit. The d.c. level voltage signal at the input to the multiplexer and the d.c. level voltage signal from the buffer output are applied by the latching circuit as inputs to the buffer circuit after the instrument player has released the key. Thus, the buffer outputs maintain the d.c. level voltage on the respective keying lines to sustain the chord output from the keyer circuit after the instrument player releases the depressed key. Each load pulse from the legato detector momentarily disables the latching circuits to allow the input multiplexer to receive new key down information from the keying lines. If the one finger chord system is deactivated and the instrument player closes the memory switch, the system retains a memory capability which is responsive only to keys actually depressed.

DETAILED DESCRIPTION

Figure 1:
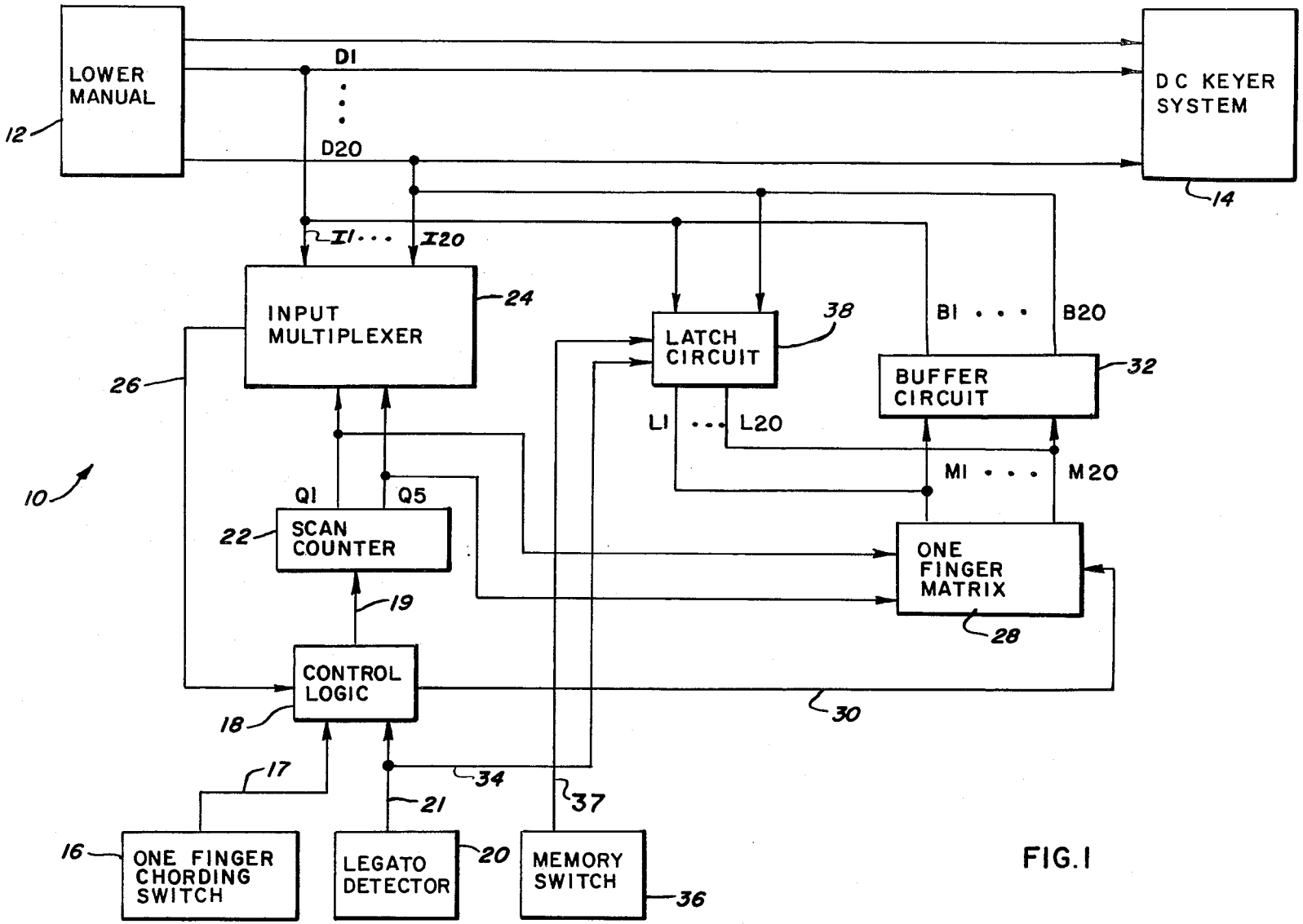
FIG. 1 is a block diagram representing the operation of the dynamic one finger chording system.

FIG. 1 illustrates in block diagram form the one finger chording system 10. The one finger or one key chording system 10 is connected in parallel across the keying or data output lines D1 through D20 of the lower manual 12 of an electronic organ. A selected number of the keys of the lower manual 12, in the preferred embodiment 20 keys corresponding to output lines D1 through D20, are connected to both the one finger chording system 10 and the standard organ d.c. keyer system 14. The standard d.c. keyer system is well-known in the art and a suitable system is disclosed in U.S. Pat. No. 3,748,944; hence further description herein is not considered necessary. When the instrument player depresses a key on the lower manual, a single key contact closes which places a d.c. level voltage signal on a corresponding keying or data output line. The d.c. level signal is connected to the d.c. keyer system 14 which produces an audio frequency signal corresponding to the key depressed. In the conventional mode of playing an electronic organ, if the instrument player desires to play a C major chord, he depresses the C, E, and G keys on the lower manual. A d.c. voltage level signal is placed on each of the keying lines corresponding to these keys and the d.c. keyer system 14 produces an audio frequency signal corresponding to a C major chord.

The one finger chording system 10 enables the instrument player to play a certain preselected group of chords by depressing a single note key instead of depressing the plurality of note keys normally associated with the chord. While twenty keys on the lower manual are connected in parallel to the one finger chording system 10 in the preferred embodiment, it should be apparent that the number of keys can be increased or decreased without departing from the scope of the present invention. The instrument player activates the one finger chording system 10 by depressing an external switch or tab 16 on the organ console. The output from the switch 16 is applied to the one finger chording system 10 and specifically as an input to the control logic circuit 18. The second input to the logic circuit 18 is from external legato detector circuit 20. The legato detector is a standard organ circuit which produces an output pulse upon the occurrence of every depression of a key even if other keys have been previously depressed and retained down. A suitable legato detector is disclosed in U.S. Pat. No. 3,821,457; however, other circuits which provide a pulse output upon every key depression could be used. The legato detector circuit 20 is responsive to the twenty keys of the lower manual connected to the one finger chording system 10. The logic discussed throughout the specification is dynamic phased clock logic which is well-known to those of ordinary skill in the art and hence for clarity of description no specific reference is made to the clock signals inherent in the system.

When the control logic circuit 18 receives an input signal from the one finger chording switch 16 on line 17 the counter 22 is turned on via line 19. The scan counter 22 is a multi-bit counter which produces a binary output signal on lines Q1 through Q5 corresponding to the position of the count. The counter is normally sequencing through each of its stages unless specifically disabled. When the control logic circuit 18 receives a new key down pulse from the legato detector 20 on line 21, it produces a disable signal to counter 22 on line 19. Thus, for the duration of the pulse from legato detector 20, the counter 22 is off as more fully explained hereinafter.

The binary output signal from scan counter 22 addresses the input multiplexer 24. The input multiplexer receives the keying or data output lines D1 through D20 from the lower manual 12 via input lines I1 through I20. As the scan counter 22 steps through the binary output from 1 through 20, each output line D1 through D20 is correspondingly interrogated to determine if there is a d.c. voltage on the line indicating a key on the lower manual is depressed. When the binary output address on lines Q1 through Q5 numerically corresponds to the ouput line D1 through D20 which has a d.c. voltage level signal, the input multiplexer 24 provides an output signal on line 26. The output signal on line 26 indicates that the scan counter 22 through the input multiplexer 24 has located a keying line with a d.c. level signal. The control logic circuit 18 is responsive to the output signal on line 26 and disables the counter 22 via line 19.

In the preferred embodiment the first key of the lower manual 12 associated with the one finger chording system is a C note and the last or 20th key is a G note in the next higher octave. However, it should be apparent to one of ordinary skill in the art that other selections or combinations of notes could be used. Since the one finger chording system is connected in parallel across the keying lines, the associated keys in the lower manual use only the single key contact necessary for standard organ operation. If the instrument player depresses the third key, a D note, the scan counter 22 will step or sequence until its output on lines Q1 through Q5 is 00011. A d.c. level voltage is on line D3 and when the counter 20 interrogates line D3, the multiplexer 24 produces an output signal on line 26. The output signal on line 26 will continue as long as the instrument player retains the key depressed and does not depress another key. However, if the instrument player releases the first key depressed or depresses another key, the output signal on line 26 from the input multiplexer 24 will disappear, the control logic circuit 18 will remove the disable signal from line 19 and scan counter 22 will again begin to sequence.

The binary output signal of the scan counter 22 is also connected to the one finger matrix 28. Upon receipt of the multiplexer output signal on line 26, the control logic circuit 18 in addition to disabling the counter 22 provides an enable signal on line 30 to the one finger matrix 28. The enabled one finger matrix 28 decodes the binary output signal of the scan counter 22 and provides a d.c. level signal at preselected ones of its output lines M1 through M20. For each one of the twenty one finger chording keys of the lower manual which is depressed, a different combination of one finger matrix output lines M1 through M20 have a d.c. level output signal. For example, if the instrument player depresses the key corresponding to data line D3, a D note, the scan counter 22 sequences until its output lines Q1 through Q5 which are connected to input multiplexer 24 are 00011. The input multiplexer 24 produces an output signal on line 26. The control logic circuit 18 is responsive to the output signal on line 26 and both disables the counter 22 via line 19 and enables the one finger matrix 28 via line 30. The one finger matrix 28 also receives the binary output 00011 on lines Q1 through Q5 of the scan counter 22 and with the enable signal on line 30 decodes the binary output to provide a d.c. level signal on lines M7 and M10.

Each output line M1 through M20 of the one finger matrix 28 is connected to buffer circuit 32 which is capable of driving the data lines D1 through D20. The buffer circuit 32 has a plurality of output lines B1 through B20 corresponding to the output lines M1 through M20 of one finger matrix 28. The buffer circuit 32 provides a high input impedance to the output lines M1 through M20. The output lines B1 through B20 are connected directly to the bidirectional input lines I1 through I20. Thus the d.c. level signal on the output lines M7 and M10 from the one finger matrix 28, according to the above example, causes the buffer output lines B7 and B10, which are connected via bidirectional lines I7 and I10, to drive data lines D7 and D10.

Each output line M1 through M20 which has a d.c. level signal from the one finger matrix 28 causes the respective data lines D1 through D20 to operate substantially in the same manner as if the key on the lower manual corresponding to those data lines were depressed. According to the above example, when the third key corresponding to the data line D3 is depressed, the one finger matrix lines M7 and M10 have a d.c. level signal and correspondingly the buffer output lines B7 and B10 apply the d.c. level signal via bidirectional lines I7 and I10 to data lines D7 and D10. The same organ keyer circuit 14 which is used for normal chord operation is also used for one finger chord operation. Therefore, d.c. keyer system 14 receives the d.c. level signal on keying lines D3, D7 and D10 and provides an audio frequency signal corresponding to the D note manually depressed by the player and the F# and A note selected by the one finger matrix 28. Thus, by depressing a single key, a predetermined chord, D major, is played.

The legato detector 20 produces a pulse on line 21 upon the depression of any one finger key on the lower manual 12 and for the duration of the pulse, the control logic circuit 18 disables the counter circuit 22. Upon the receipt of each legato pulse the control logic circuit 18 removes the enable signal from the one finger matrix 28. The one finger matrix 28 is disabled to remove the signals from output lines M1 through M20 and correspondingly from the lines B1 through B20 and lines I1 through I20 during the receipt of new key down information from the lower manual. If the one finger matrix 28 was not disabled during this interval, inaccurate information would be received by the input multiplexer 24. The inaccurate information would be both the key depressed input from data lines D1 through D20 and the previous one finger information from the prior chord on lines B1 through B20.

If the instrument player has depressed a one finger key on the lower manual such as the third key, a D note, the one finger chording system 10 provides a F# and A note signal to the keyer circuit 14 and the D major chord is played. As is customary, the D major chord is sustained as long as the instrument player retains the D note key depressed. When the instrument player releases the depressed key, the d.c. voltage level on the associated keying line is removed and the output signal on line 26 from input multiplexer 24 is removed. The control logic circuit 18 correspondingly removes the enable signal from line 30 to the one finger matrix 28 removing the d.c. level signal on output lines M1 through M20 and removes the disable signal on line 19 to the scan counter 22. The scan counter 22 resumes the counting sequence to search for another d.c. level signal on keying lines D1 through D20.

However, if the instrument player depresses another one finger key while maintaining the D note key down, the present one finger chording system plays a new chord corresponding to the new key depressed. While the D note key is depressed the multiplexer 24 maintains an output signal on line 26 and therefore the control logic circuit 18 continues to disable the counter 22 from scanning and to enable the one finger matrix 28 via line 30. Thus, if a new key is depressed by the instrument player without releasing the previously depressed key, the counter 22 would not sequence but would remain at the count associated with the first key depressed and the same chord would be played. This undesirable locking up is common in static one finger chording systems and is prevented by the present dynamic one finger chording system in the following manner.

The control logic circuit 18 provides a pulse of short duration, preferably one clock cycle, at the falling edge of the legato pulse on line 21. The pulse of one clock cycle duration is applied to counter 22 via line 19 and forces the counter 22 to sequence once. As soon as the counter 22 sequences once, its binary output no longer corresponds to the keying line with the d.c. level voltage due to the D note, the first key depressed. The output signal on line 26 from multiplexer 24 vanishes and the control logic circuit 18 removes the disable signal from counter 22. The counter 22 now begins its normal sequencing until the next keying line with a d.c. level voltage is detected. The next keying line with a d.c. level voltage signal corresponds to the second key depressed by the instrument player. For example, if the instrument player had the third key, a D note, depressed, the D major chord is played as described above. Now, if the instrument player retains the third key depressed and also depresses the sixth key, a F note, the pulse of one clock cycle duration from the sixth key via control logic circuit 18 causes the counter 22 to sequence once from 00011 to 00100. Thus, the counter 22 is stepped off keying line D3 which still has a d.c. level signal to line D4 which does not have a d.c. level signal. The output signal on line 26 from multiplexer 24 vanishes and logic control circuit 18 removes the disable signal from counter 22. The counter 22 begins its normal sequencing to 00101 corresponding to keying line D5 which does not have a d.c. level signal and then to 00110 corresponding to keying line D6 which has a d.c. level signal due to the sixth key being depressed. The multiplexer 24 now provides an output signal on line 26 to the control logic circuit 18 which disables the counter 22. The control circuit 18 enables one finger matrix 28 via line 30. The one finger matrix 28 provides an output signal on lines M10 and M13 which via buffer circuit 32 and bidirectional lines I10 and I13 places a d.c. level signal on keying lines D10 and D13. The keyer circuit 14 receives a d.c. level voltage on line D6, a F note, due to the manual depression of the sixth key, and a d.c. level voltage on lines D10 and D13 due to the one finger matrix. Thus, the notes FAC or a F major chord is played. The above is assuming that the dual depression of the third and sixth keys was momentary, if the third key is still retained down a d.c. level voltage is maintained on line D3 and the keyer circuit 14, in addition to the F major chord, plays the D note.

In the memory mode of operation, the d.c. level signals upon lines D1 through D20 are sustained until a new key upon the lower manual 12 is depressed. Thus upon the depression and subsequent release of a one finger chording key by the instrument player, a corresponding chord is sustained until the instrument player depresses a new one finger chording key. The memory function is implemented by the instrument player by depressing a tab or switch 36 on the keyboard console. The signal from external switch 36 via line 37 is received by the one finger chording system 10 and specifically enables latch circuit 38. Latch circuit 38 receives inputs from data lines D1 through D20 via lines I1 through I20 and from the buffer output lines B1 through B20. Now, according to the example recited above, the d.c. level signal on line D3 of data lines D1 through D20 is applied to input multiplexer 24 on line I3. Latch circuit 38 receives the d.c. level signal on line I3 as well as the d.c. level signal on lines B7 and B10 from the one finger matrix 28 and buffer circuit 32. The output lines L1 through L20 of latch circuit 38 are connected respectively to the output lines M1 through M20 of the one finger matrix 28. According to the example, the latch circuit output lines L3, L7 and L10 have a d.c. level signal and each is connected respectively to M3, M7 and M10. The lines M7 and M10 already have a d.c. level signal and show no change while M3 now has a d.c. level signal via line L3. Correspondingly, buffer output lines B3, B7 and B10 now have a d.c. level signal. The buffer output lines B3, B7 and B10 are connected via bidirectional lines I3, I7 and I10 to drive the data lines D3, D7 and D10 after the instrument player has released the depressed key.

When the instrument player releases the key corresponding to line D3, the D major chord continues to be played. Normally when the key on the lower manual is released, the output on line 26 from the input multiplexer 24 is removed and control logic 18 disables the one finger matrix 28 which removes the d.c. level signal from the output lines M1 through M20. With the memory feature activated, the above occurs but the latch circuit 38 operates similar to a positive feedback circuit to apply a d.c. level signal on lines L3, L7 and L10 to the buffer circuit 32 and sustains the output on lines I3, I7 and I10. The next pulse from the legato detector 20 disables the latch circuit 38 and effectively interrupts the positive feedback loop to remove the d.c. level signal from the buffer output lines B1 through B20. This interruption upon receipt of new key down information from the lower manual 12 is important to assure the proper information input to input multiplexer 24 as described above.

Figure 2A:
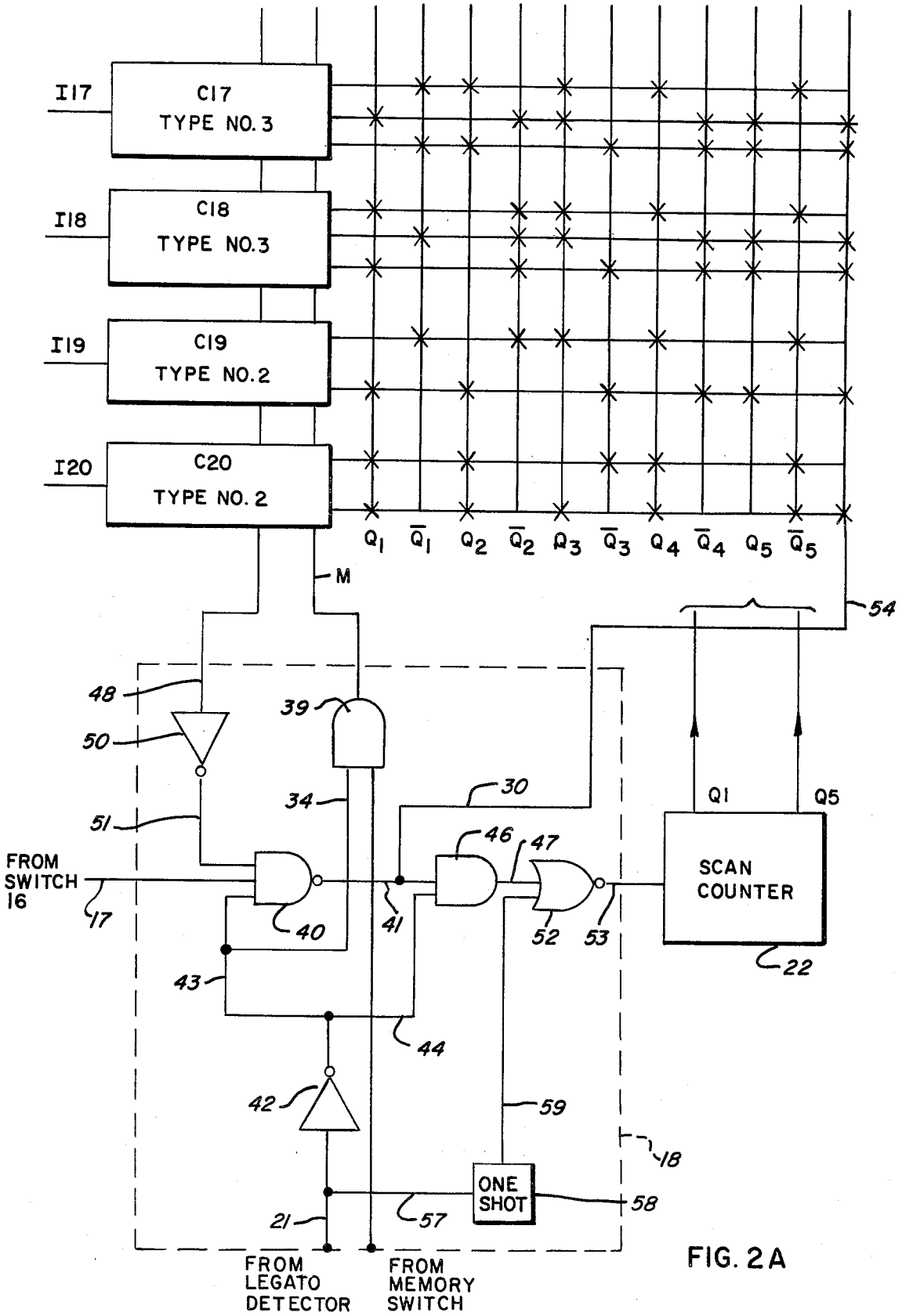
FIGS. 2*a*–2*c* are a schematic diagram of the dynamic one finger chording system.
Figure 2B:
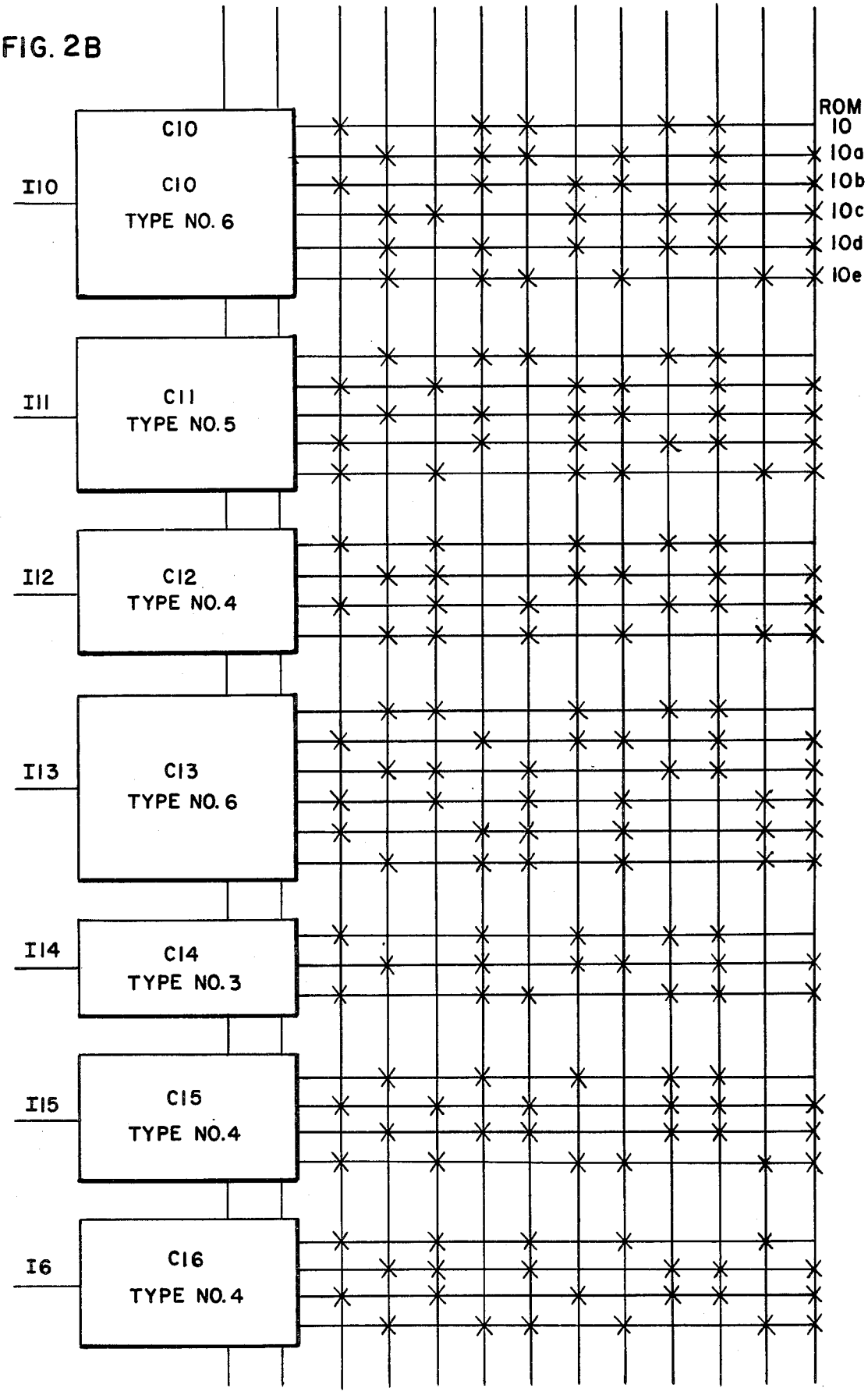
Figure 2C:
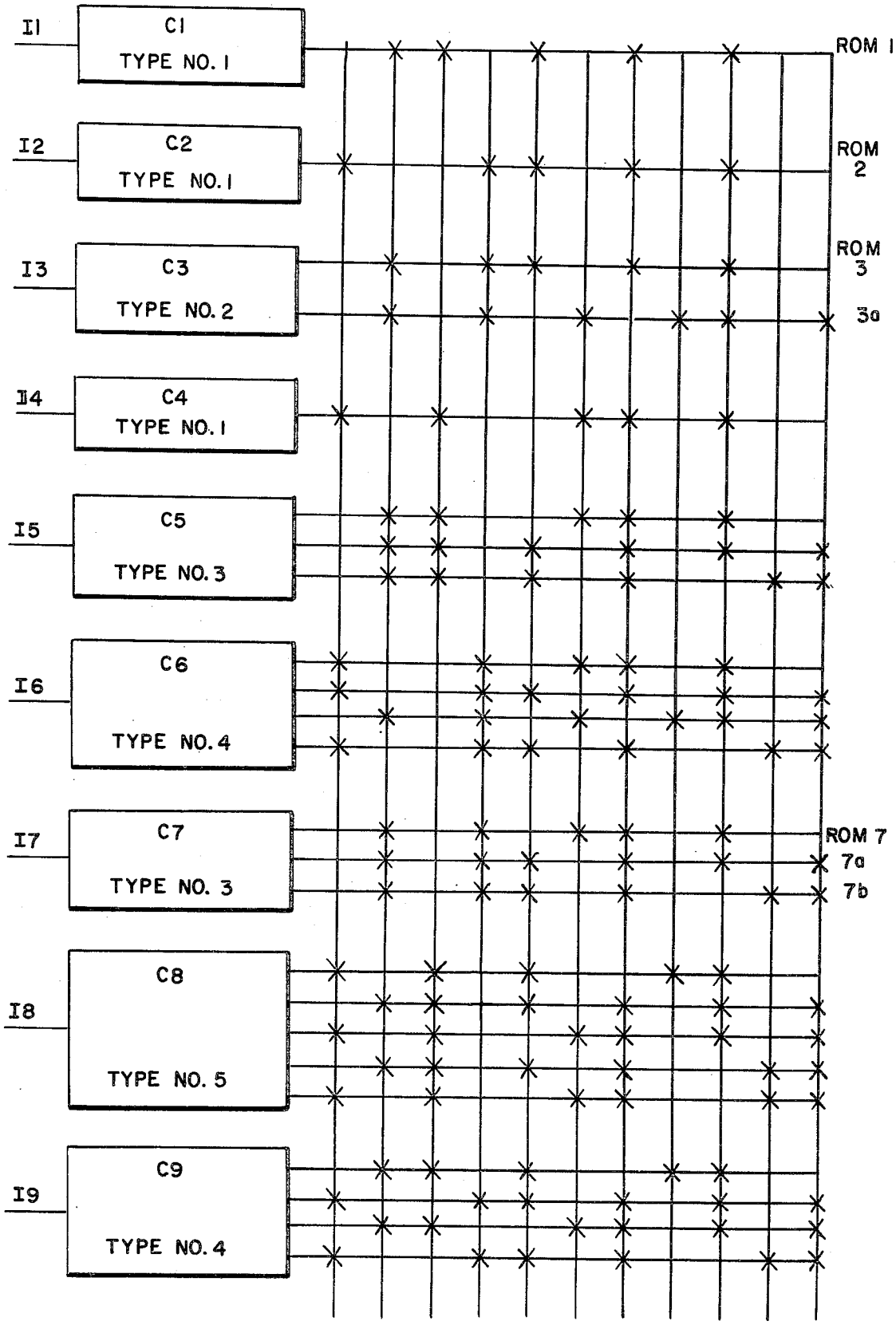

FIGS. 2*a* through 2*c* are a detailed logic circuit for the one finger chording system 10 which is illustrated in functional block diagram form in FIG. 1. The same numbers have been used to denote the same elements when appropriate. The instrument player activates the one finger chording system by turning switch 16, illustrated in FIG. 1, to the on position. The counter 22 is normally counting or sequencing unless specifically disabled. The binary output of the counter 22 is applied via lines Q1 through Q5 to the read only memory 54. The ROM 54 will interrogate through circuits C1 through C20 each input line I1 through I20 which are respectively connected to the keying lines to determine if a d.c. level voltage is present representing a key depressed. Thus, the ROM 54, together with circuits C1 through C20, provide the multiplexing function as described in FIG. 1. When a d.c. level voltage signal is detected at one of the input lines I1 through I20, a signal is produced on common output line 48 to the logic circuit 18. The logic circuit 18 disables the counter 22 and enables the ROM 54. The ROM 54 receives the enable signal on line 30 and the output of counter 22 on lines Q1 through Q5. The ROM 54 provides a d.c. level output signal on a predetermined number of its output lines, depending upon the output of counter 22. The ROM 54 is providing the function of the one finger matrix 28 of FIG. 1. The output of the ROM 54 is applied to the circuits C1 through C20 which perform as the buffer circuits 32 of FIG. 1 to connect the d.c. level signal via lines I1 through I20 to the keying lines. A detailed description of the operation of the one finger chording system 10 as shown in FIGS. 2–5 follows below.

The instrument player activates the system by placing the one finger chord switch 16, illustrated in FIG. 1, in the on position which places a logic 1 on line 17. Line 17 is connected to the control logic circuit 18 and specifically to the first input of NAND gate 40. The legato detector 20, illustrated in FIG. 1, normally maintains a logic 0 state at line 21 which is connected to inverter 42. The logic 1 state output of inverter 42 via line 43 is connected to the second input of NAND gate 40. The third input to NAND gate 40 is on line 51 from the bank of circuits C1 through C20 via common line 48 and inverter 50. The third input to NAND gate 40 is normally at a logic 0 state as fully explained hereinafter. The logic 1 state output of NAND gate 40 on line 41 is applied to the first input of AND gate 46. The logic 1 state output of NAND gate 40 on line 41 is also connected to disable read only memory 54 via line 30 as fully explained hereinafter. The logic 1 state output of inverter 42 on line 44 is connected to the second input of AND gate 46. The logic 1 state output of AND gate 46 on line 47 is connected to the first input of NOR gate 52. The second input to NOR gate 52 on line 59 is normally at a logic 0 state as fully explained hereinafter. The logic 1 state output on line 41 changes the output of NOR gate 52 on line 53 to a logic 0 state. The logic 0 state output on line 53 is connected to counter 22 and permits the counter 22 to sequence. Thus, counter 22 is normally constantly sequencing when the one finger chording system is in use unless specifically disabled, as fully explained hereinafter.

The instrument player now depresses one of the twenty one finger chord keys on the lower manual 12. The single key contact associated with the depressed key closes placing a d.c. level voltage on one of the key lines. Each of the keying lines D1 through D20, illustrated in FIG. 1, are connected via input lines I1 through I20 to the respective inputs of circuits C1 through C20. In addition, upon key depression, the legato detector 20 places a logic 1 pulse on line 21 which is connected to inverter 42. The output of inverter 42 is a load pulse at a logic 0 state and is connected on line 43 to the second input of NAND gate 40. The third input to NAND gate 40 is normally at a logic 0 state. Thus, the output on line 41 of NAND gate 40 remains at a logic 1 state which disables ROM54 via line 30. The output on line 41 of NAND gate 40 is also connected as the first input to AND gate 46. The output of the load pulse from inverter 42 is connected on line 44 to the second input of AND gate 46. Thus, during the time duration of the load pulse the first input on line 41 to gate 46 is at a logic 1 state, the second input on line 44 is at a logic 0 state and the output of AND gate 46 on line 47 is at a logic 0 state. Line 47 is connected to the first input of NOR gate 52. The output on line 53 of NOR gate 52 is now at a logic 1 state. The output of NOR gate 52 on line 53 is connected as the input to counter 22. A logic 1 state on line 53 to the counter disables the counter from operating. Thus, for the duration of the load pulse, the counter 22 is disabled and ROM 54, which provides the same function as the one finger matrix 28 and multiplexer 24 of FIG. 1, is disabled.

Furthermore, to allow the one finger chording system 10 to begin scanning in search of a new d.c. level keying line if the instrument player depresses a second key without releasing a prior depressed key, the output line 21 from legato detector 20 is connected via line 57 to one shot 58. The load pulse from the legato detector 20 is approximately 30 ms. in duration and the falling edge of the load pulse causes the one shot 58 to produce a logic 1 pulse at output line 59 for one clock cycle duration. The output line 59 is connected to the second input to NOR gate 52. The logic 1 state on line 59 changes the logic state of output line 53 to logic 0 which removes the disable signal from the counter for a single clock pulse causing the counter to sequence once. The single sequence of the counter 22 causes the line 48 to change to a logic 1 state as more fully explained hereinafter and scanning resumes.

After the load pulse from legato detector 20 is gone, line 43 returns to a logic 1 state. However, the inputs to NAND gate 40 are a logic 0 at line 51, a logic 1 on line 17 and a logic 1 at line 43. The output on line 41 of NAND gate 40 is a logic 1 state. The logic 1 state on line 30 maintains ROM54 disabled as explained hereinafter. Since the load pulse is gone, line 44 is at a logic 1 state. Now, both inputs to AND gate 46 are at a logic 1 state. The logic 1 on output line 47 of AND gate 47 is applied to the first input of NOR gate 52. The one clock cycle pulse on line 59 is gone and the second input to NOR gate 52 is at a logic 0 state. The output at line 53 of NOR gate 52 is then at a logic 0 state. The disable signal is thus removed from counter 22 and the counter 22 begins to sequence.

The scan counter 22 is a standard 5-bit counter with a count enable well-known in the prior art. The counter 22 has five sets of output lines Q1 through Q5, each set of lines contains a Q output and a $\overline{Q}$ output line. The combination of output lines Q1 through Q5 provide a binary output signal which sequences from 00001, 00010, 00011, etc. through 11111. However, since only twenty keys of the lower manual 12 are associated with the one finger chording system 10 the useful counter output is only from a binary 00001 through 10100 with the remainder of the sequence being disregarded. Therefore, it should be apparent to one of ordinary skill in the art that the 5-bit counter could be modified to only count to binary 20 before recycling.

The read only memory 54 is a well-known device in the art and the symbolic X indicates the ROM code for the preferred embodiment. As is well-known in the art, the symbolic X indicates that the output line from the counter 22 is connected as the input to a transfer device which is a MOS transistor. Each transfer device is connected between a line in the ROM 54 and ground, at a logic 0. The input to each transfer device connected to a line in ROM 54 must be at a logic 0 state before the input to the associated circuit C is at a logic 1 state. Each line in ROM 54 functions as a multiple input NOR gate with the number of inputs corresponding to the number of transfer devices connected to the line.

For example, when the counter 22 is at the first step in its output sequence the Q output line of set Q1 is at a logic 1 and the Q output lines of the remaining sets Q2 through Q5 are at a logic 0. Of course the $\overline{Q}$ lines of each set are at the opposite logic state. Now, in ROM 54, the $\overline{Q}$ line of Q1 and the Q line of Q2 through Q5 are connected via transfer devices to line ROM 1. This internal condition of the ROM 54 is symbolically illustrated with an X. A depletion pull up device which is well-known in the art and not illustrated in the drawing for the sake of simplicity is connected to each line in ROM 54 and keeps each line at a logic 1 state when all the inputs of the transfer devices are logic 0. If any input to the transfer devices connected to line ROM 1 is in the logic 1 state, the line ROM 1 would be set to a logic 0 state.

When the counter 22 is at the second step in its output sequence the Q line of Q2 is at a logic 1 state, the Q line of Q1 and Q3 through Q5 are at a logic 0 state. Thus, line ROM 1 connected via a transfer device to the Q line of Q2 is pulled to a logic 0 state while each transfer device connected to line ROM 2 (represented by X) is connected to a logic 0 input line from counter 22 and the output to circuit C2 on line ROM 2 is at a logic 1 state.

When the counter 22 is at the third step in its output sequence the Q line of Q1 and Q2 are at logic 1 and the Q line of Q3 through Q5 are at logic 0. Thus, line ROM 1 connected via a transfer device to the Q line of Q2 is pulled to a logic 0 state and line ROM 2 connected via a transfer device to the Q line Q1 is pulled to a logic 0 state. However, each transfer device connected to line ROM3 is connected to a logic 0 input line from counter 22 and the output to circuit C3 on line ROM3 is at a logic 1 state.

Figure 3:
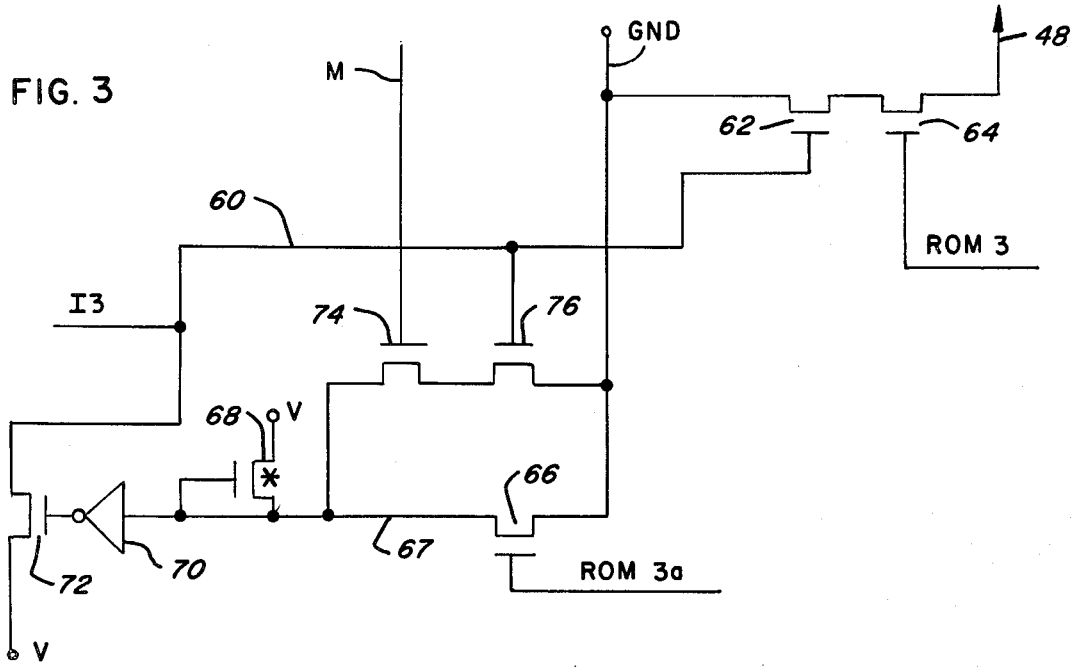
FIGS. 3–5 are schematic diagrams of specific circuits of the dynamic one finger chording system.

With reference to circuit C3 in FIG. 3, if the instrument player has depressed the third key, a D note, then a logic 1 state is on line D3 which connects to bidirectional input line I3. The logic 1 is applied via line 60 as the input to transfer device 62. The source terminal of transfer device 62 is connected to a common ground line GND at a logic 0 state. The logic 1 state at the input to transfer device 62 forces the drain terminal to a logic 0 state. The line ROM3 due to the sequence of counter 22 is at a logic 1 state as described above and is connected to the input of transfer device 64. The source terminal of transfer device 64 is at a logic 0 state due to transfer device 62. The transfer device 64 with a logic 1 at its input forces its drain to a logic 0 state. The drain terminal of transfer device 64 is connected to the common output line 48 of all the circuits C1 through C20. The remainder of the components of circuit C3 and their operation is fully explained hereinafter. Thus, the d.c. level signal on keying line D3 due to the instrument player depression of the third key is detected by ROM54 and circuit C3.

Now, when line 48 is at a logic 0 state, the output of inverter 50 on line 51 of FIG. 2 is a logic 1 state. All inputs to NAND gate 40 are now at a logic 1 state and its output on line 41 is at a logic 0 state. The line 41 is the second input to AND gate 46 and the first input to AND gate 46 is at a logic 1 state on line 44. The output of AND gate 46 on line 47 changes to a logic 0. The line 47 is applied as an input to NOR gate 52. The output of NOR gate 52 on line 53 changes to a logic 1 state and the counter 22 is disabled. Thus, the logic control circuit 18 disables the scan counter 22 when a keying line with a d.c. level signal is located.

The logic 0 state on line 41 in the logic control circuit 18 is connected to the ROM54 via enable line 30. The logic 0 state on line 30 is applied to the input of a transfer gate on line ROM7*a* as is indicated by the symbolic X shown in FIG. 2*c*. Now the output of the counter 22 is stopped at the third step, the Q line of Q1 and Q2 is at a logic 1 state and the Q line of Q3 through Q5 is at a logic 0 state. The line ROM7*a* is connected through appropriate transfer devices to the $\overline{Q}$ lines of Q1 and Q2 and the Q lines of Q3 through Q5 and to enable line 30. Since each of the inputs to the transfer gates on line ROM7*a* is a logic 0 state, the output on line ROM7*a* is at a logic 1 state. The logic 1 state of line ROM7*a* is connected to circuit C7, as shown in FIG. 4.

Figure 4:
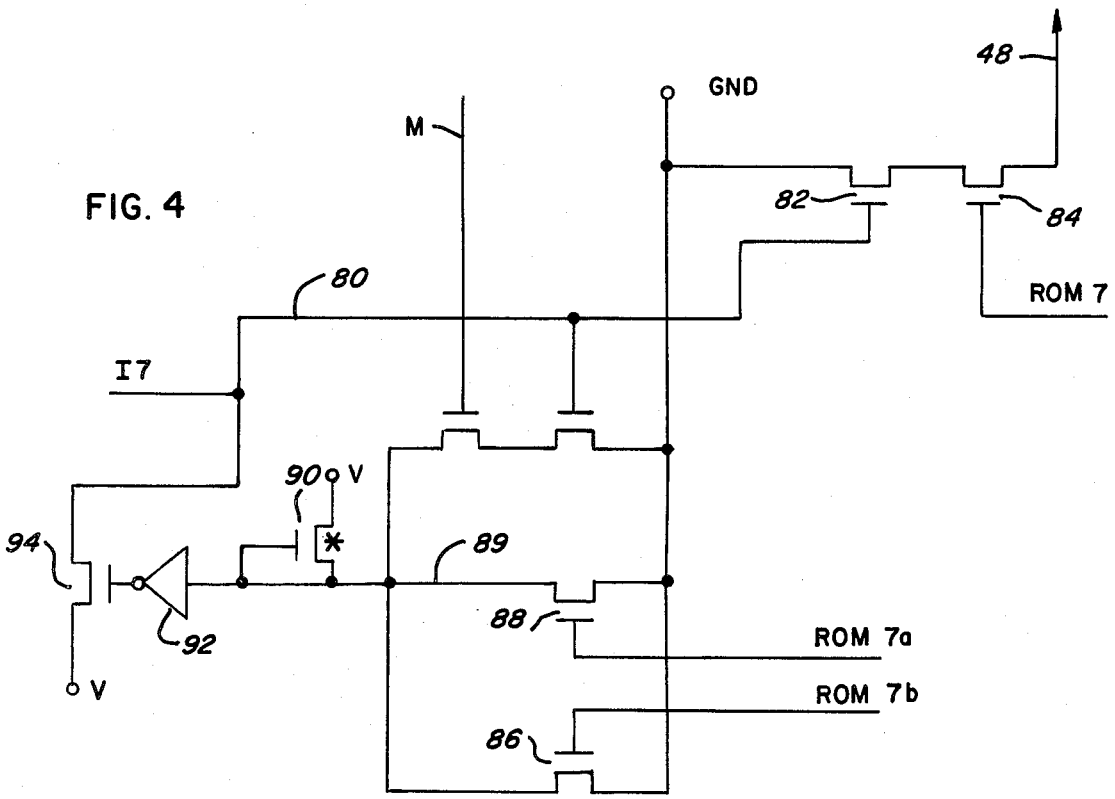
Figure 5:
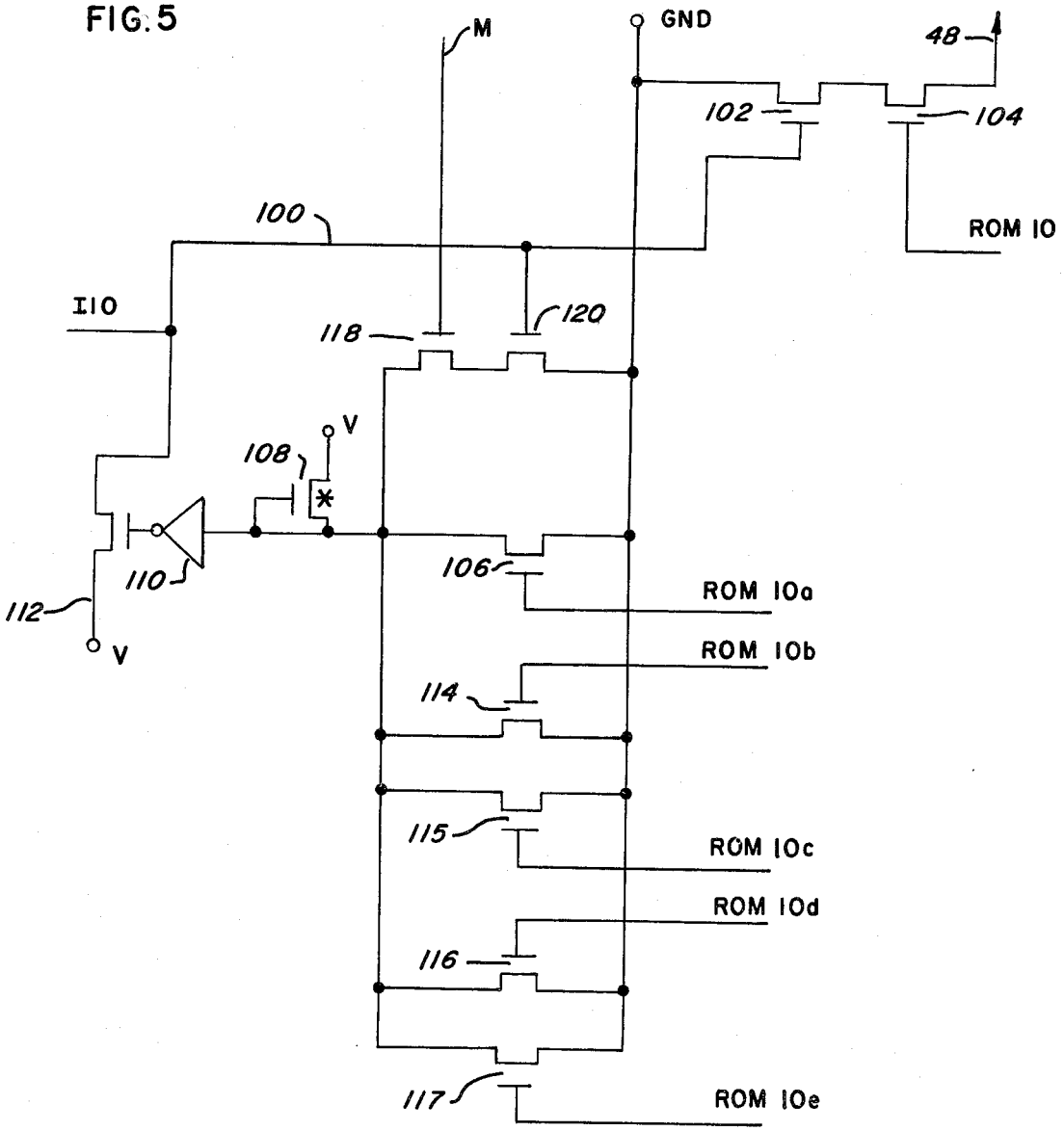

The circuit C7 in FIG. 4 operates in a similar manner to circuit C3 in FIG. 3, no input is received on line I7 since the key corresponding to data line D7, F# note, is not manually depressed. Therefore, line 80 is at a logic 0 state. The line 80 is connected as the input to transfer device 82 which does not operate with a logic 0 at its input. Line ROM7 from the ROM54 is at a logic 0 state since the output of the counter 22 is at a binary 00011 and line ROM7 is connected via transfer devices to the Q output of line Q4 and the $\overline{Q}$ outputs of lines Q1, Q2, Q3 and Q5. Thus, both the Q3 and Q5 output line place a logic 1 state at the input to their respective transfer gates which pull line ROM7 to a logic 0 state. The line ROM7 is connected to the input of transfer device 84 in FIG. 4.

However, the logic 1 signal is on line ROM7*a*. The counter 22 is at a binary 00011 and line ROM7*a* is connected via transfer devices to the $\overline{Q}$ output of lines Q1 and Q2 and to the Q output of lines Q3 through Q5 and to enable line 30. Thus a logic 0 state is at the inputs to each transfer device on line ROM7*a*. Furthermore, a logic 0 state is at line ROM7*b* since it is connected via transfer devices to the $\overline{Q}$ output of lines Q1, Q2 and Q5 and the Q output of lines Q3, Q4 and enable line 30. Thus the Q5 output line places a logic 1 at the input to its respective transfer gate which pulls line ROM7*b* to a logic 0 state. The logic 0 state on line ROM7*b* is connected to the input of transfer device 86. The logic 0 state at the input does not turn transfer device 86 on.

The line ROM7*a* is received as the input to transfer device 88. The source of transfer device 88 is connected to a common ground line. The logic 1 state at the input to transfer device 88 forces the drain terminal to a logic 0 state on line 89. The logic 0 state on line 89 passes through depletion pull up device 90 which will normally keep line 89 at a logic 1 state. The logic 0 on line 89 is connected to the inverter 92. The logic 1 output of inverter 92 is connected to transfer device 94. The source terminal of the transfer device 94 is connected to a logic 1 voltage level V. The transfer device 92 operates as a driver to force line 80 to the logic 1 state. The circuit C7 is operating as the buffer circuit 32 of FIG. 1, and since line 80 is connected via bidirectional line I7 to data line D7 the d.c. keyer system 14 plays the F# note.

To complete the one finger chording sequence, the ROM54 must provide a d.c. level signal to at least one more output line. Therefore, with reference to circuit C10 of FIG. 5, the output of binary counter 22 is at 00011 and the $\overline{Q}$ output of lines Q1 and Q2 and the Q output of line Q3 through Q5 and the enable line 30 are connected via transfer devices to line ROM10*a*. Thus, each input to the transfer devices on line ROM10*a* is at a logic 0 state and the input to circuit C10 on line ROM10*a* is at a logic 1 state. The circuit C10 in FIG. 5 operates in a similar manner to circuit C3 and circuit C7, no input is received on line I10 since the key corresponding to data line D10, A note, is not manually depressed. Therefore, line 100 is at a logic 0 state. The line 100 is connected as the input to transfer device 102 which does not operate with a logic 0 at its input. Line ROM10 from ROM54 is at a logic 0 state since the ouput of counter 22 is connected via transfer devices to the $\overline{Q}$ output lines of Q2 and Q4 and the Q outputs of Q1, Q3 and Q5. Thus, both the Q4 and Q1 output lines place a logic 1 state at the inputs to their respective transfer devices which pull line ROM 10 to a logic 0 state. The line ROM10 is connected to the input of transfer device 104.

The input to circuit C10 on line ROM10*a* is a logic 1. The logic 1 state on line ROM10*a* is connected to the input of transfer device 106. The source of device 106 is connected to the common ground. The logic 0 at the drain transfer device 106 passes the depletion pull up device 108 and is connected as the input to inverter 110. The logic 1 state at the output inverter 110 is applied to the driver transfer gate 112. The source of the transfer device 112 is connected to a logic 1 voltage state V. The drain of transfer device 112 is connected through line 100 to line I10 and subsequently to data line D10. The circuit C10 is operating as the buffer circuit 32 of FIG. 1 and the logic 1 state of line I10 forces the d.c. keying system 14 to play the A note. The lines ROM10*b* through ROM10*e* are respectfully connected to transfer gates 114 through 117 which do not turn on with a logic 0 state at their respective inputs.

Thus, a logic 1 state is on the data line D3 from the manual depression of the third key and a logic 1 state is on data lines D7 and D10 due to the one finger chording system. The d.c. keyer circuit 14 thereby plays a D major chord, DF#A, in response to the single D note key depression.

If the instrument player retains the third key down the logic 1 state signal will remain at the I3 line to circuit C3 of FIG. 3 and the D major chord is sustained. If the instrument player releases the third key from its depressed position a logic 0 state is at I3 and line 60 is at a logic 0 state. The transfer device 62 has a logic 0 at its input and is off. Thus line 48 is at its normal logic 1 state. Therefore, the output of inverter 50 in FIG. 2 is at a logic 0 state and the output of NAND gate 40 is at a logic 1 state. Both inputs to the AND gate 46 are a logic 1 and the output on line 47 is a logic 1. The output on line 47 is connected to NOR gate 52 and its output changes to a logic 0 state. Thus the control logic circuit 18 removes the disable signal from the counter 22 and the scanning or sequencing begins again.

The output lines from ROM54 are connected as inputs to the bank of circuits C1 through C20. Each of the circuits C1 through C20 is one of six different types depending upon the number of inputs it receives from ROM54. The number of inputs each circuit receives from ROM54 depends upon the number of times that the key of the lower manual 12 which is associated with the circuit is used in the various one finger chords. The relationship between each of the twenty keys of the lower manual 12 and the additional notes to be played by the one finger chording system 10 is set forth in the following chart.

| Key No. Manually Depressed & Note | One Finger Chord Associated Output | Notes Played | Chord |
|---|---|---|---|
| 1 | 5, 8 | CEG | C major |
| 2 | 6, 9 | C#FG# | C# major |
| 3 | 7, 10 | DF#A | D major |
| 4 | 8, 11 | E♭GB | E major |
| 5 | 9, 12 | EG#B | E major |
| 6 | 10, 13 | FAC | F major |
| 7 | 11, 14 | F#A#C# | F# major |
| 8 | 12, 15 | GBD | G major |
| 9 | 13, 16 | G#CD# | G# major |
| 10 | 14, 17 | AC#E | A major |
| 11 | 15, 18 | B♭DF | B major |
| 12 | 16, 19 | BD#F# | B major |
| 13 | 17, 10 | ACE | A minor |
| 14 | 18, 11 | B♭D♭F | B minor |
| 15 | 3, 6, 10 | DFAD | D minor |
| 16 | 13, 20 | CE♭G | C minor |
| 17 | 5, 8, 12 | EGBE | E minor |
| 18 | 6, 9, 13 | FA♭CF | F minor |
| 19 | 7, 10, 13, 16 | F#ACD#F# | F# diminished |
| 20 | 8, 11, 15 | GB♭DG | G minor |

Thus, if the instrument player desired to play a D minor chord and depresses the fifteenth key, the manually depressed key places a logic 1 state of line D15 and the one finger chording system 10 as described above places a logic 1 state on lines D3, D6 and D10. Therefore, the circuits C1 through C20 corresponding to data lines D3, D6 and D10 receive a logic 1 input from ROM54. Referring to FIG. 3, circuit C3 which is a type 2 circuit is illustrated. This circuit receives a logic 1 state on line ROM3*a*. The line ROM3*a* is connected to the input of transfer gate 66. The source of transfer gate 66 is connected to the common ground GND and the logic 1 input places the logic 0 at the drain terminal of transfer device 66. The logic 0 state on line 67 passes the depletion pull up devices 68 which normally maintains the line 67 at a logic 1 state. Line 67 is applied as an input to inverter 70. The output of inverter 70 is at a logic state and is applied as the input to driver transfer gate 72. The source terminal of transfer gate 72 is a logic 1 voltage V and drives line I3 to a logic 1 state. The same operation as described above places a d.c. level signal on lines I6 and I10. The keyer circuit 14 receives a d.c. level signal on lines D15, D3, D6 and D10 and provides a D minor output.

From the above examples, it is apparent that the type two circuit C has two inputs from ROM54. A type three circuit C has three inputs from ROM54 indicating that the corresponding note key is used in three one finger chords as shown in the above chart. Since the circuit structure of the other types of circuits C would be obvious to one of ordinary skill in the art from the above description and FIGS. 3–5 the other circuit types are not specifically disclosed herein.

If the instrument player depresses the third key, a D note, and retains the key depressed, the keyer circuit produces a sustained D major chord. Now if the instrument player depresses the sixth key, a F note, but does not release the third key, the legato detector 20, as illustrated in FIG. 1, produces a load pulse on line 21. As shown in FIG. 2*a*, line 21 is connected via line 57 to one shot 58 of logic control circuit 18 which upon the falling edge of the load pulse produces a pulse on line 59 of one clock cycle duration. The line 59 is connected to the second input of NOR gate 52. The logic 1 state at the input to NOR gate 52 changes its output on line 53 to a logic 0 state. This causes the counter 22 to step once from output 00011 to 00100. The logic state of line 48 changes to logic 1 since the line D3 is no longer being interrogated by the ROM54 but the line D4 without a d.c. level signal is being interrogated. The third input to NAND gate 40 of logic control circuit 18 is at a logic 0 state and the counter 22 is allowed to sequence to detect the d.c. level signal on line D6. Thus, the one finger chording system will detect a new key depression, stop playing the prior chord associated with the first key depression and play a new chord associated with the new key depression. The dynamic one finger chording system does not produce two chords even if two keys on the lower manual are coincidentally depressed.

In the memory mode of operation the one finger chording system 10 sustains the chord output associated with the depressed key after the key is released and until a new key is depressed. If the instrument player desires to energize the memory function switch 36 on the instrument console, as illustrated in FIG. 1, is placed in the on position. The switch 36 places a logic 1 signal on memory engage line M via AND gate 39. The line M is connected to each of the circuits C1 through C20.

As shown in FIG. 3 the line M is connected to the input of transfer device 74. As in the previous example, if the instrument player depresses the third key, D note, in addition to operating as described above the logic 1 state on line 60 is applied to the input of transfer device 76 in circuit C3. The source of transfer device 76 is connected to ground. Upon receipt of the logic 1 state at the input the logic 0 state is transferred to the drain. Since there is now a logic 1 state via line M to the input of transfer device 74, the logic 0 state passes to the drain of transfer device 74. Now the logic 0 state passes the depletion pull-up device 68 and is connected to the input of inverter 70. The logic 1 output of inverter 70 is applied to the input of driver transfer gate 72. The logic 1 state of line I3 is connected to the data output line D3. As long as the instrument player retains the third key depressed the memory function has no effect since the key depression maintains a logic 1 at line I3. In the memory mode if the instrument player releases the third key the chord continues to be played since the output logic 1 from transfer device 72 is connected via line 60 to the input of transfer device 76 and the remainder of the circuit operates as before. Therefore, the logic 1 state is fed back via the memory transfer device 74 to maintain the line D3 at a logic 1 state.

Similarly, the input line I7 to circuit C7 in FIG. 4 is maintained at a logic 1 state. The circuit C7 receives the logic 1 state from ROM7*a* which connects to the gate transfer device 88. The remainder of the circuit C7 operates as before, except since line M is at a logic 1 state the feedback path is closed including transfer devices 96 and 98. Of course, circuit C10 operates in the same manner as described for circuits C3 and C7 and since line M is at a logic 1 state the feedback path is closed including transfer devices 118 and 120. Thus, the chord output via lines D3, D7 and D10 is sustained after the instrument player releases the depressed key.

Upon the depression of a new key the output of line 21 is at a logic 1 state. The logic 1 output on line 21 is connected to inverter 42 and the logic 0 output of inverter 42 via line 34 is connected to AND gate 39 of control logic 18. The logic 0 at one input to AND gate 39 changes the output on line M to a logic 0 state which interrupts the memory function. The output of AND gate on line M is at a logic 0 state and the positive feedback loop is opened and the logic 1 state removed from the respective lines D1 through D20.

In an alternative embodiment, the memory capacity of the one finger or one key chording system can be used independently to provide a sustained output. The sustained output corresponds to a single key or a group of keys actually depressed by the instrument player and remains until a new key is depressed or the memory function disabled. The same circuitry as described above is used. If the instrument player does not turn on the one finger chord system switch 16 but does turn on the memory switch 36, the memory capability is activated but the one finger chord system is inoperative.

If the switch 16 is in the OFF position, the line 17 in FIG. 2 is at a logic 0 state which holds the output of NAND gate 40 at a logic 1 state. The logic 1 state output of NAND gate 40 is applied on line 30 to disable ROM 54. If switch 36 is in the ON position, the line M in FIG. 3 is at a logic 1 state since both inputs to AND gate 39 are true or at a logic 1 state. Now, if the instrument player depresses the key corresponding to keying line D3, a logic 1 state signal is present at line I3 in FIG. 3. The logic 1 state signal is applied on line 60 to the gate of transfer device 76. The source of transfer gate 76 is connected to the common ground and the logic 0 state ground is applied to the drain terminal. Since the line M is at a logic 1 state and applied to the gate of transfer device 74, the logic 0 state at the drain of transfer device 76 is passed by the transfer device 74. The logic 0 signal is applied via depletion pull up device 68 to the input of inverter 70. The logic 1 state output of inverter 70 is applied to the gate of transfer device 72. The transfer device 72 applies a logic 1 state signal to line I3 which drives the standard keyer circuit to provide a D note output. A similar operation occurs if the organist depresses multiple keys. If the organist releases the depressed key, the signal on line I3 remains due to the feedback loop discussed above. Of course, each of the other C type circuits operates in the same manner. Therefore, the organist can use the memory capability of the system without actuating the one finger chording function.

It is to be understood that the present disclosure is to be interpreted in its broadest sense and the invention is not to be limited to the specific embodiments disclosed. Furthermore, the embodiments set forth can be modified or varied by applying current knowledge without departing from the spirit and scope of the novel concepts of the invention.

Having described the invention, what is claimed is:

1. A dynamic one finger chording system for use in an electronic musical instrument having a keyboard, a keyer circuit for providing audio frequency range signals, a plurality of keying lines connecting said keyboard to said keyer circuit and said dynamic one finger chording system connected in parallel to at least some of said keying lines and comprising:

an input circuit receiving at least some of said keying lines and having a match output line;

continuously sequencing counter means having a plurality of address lines connected to said input circuit for scanning and received keying lines for a signal representing the depression of a corresponding key on said keyboard by an instrument player;

said input circuit providing a match signal upon said match output line when said keying lines having a signal representing the depression of a corresponding key on said keyboard is detected by said counter means;

a control circuit receiving said match output line and having an enable output line for providing an enable signal in response to said match signal;

a matrix receiving said enable output line from said control circuit and said address lines from said counter and having a plurality of matrix output lines and providing a matrix output signal related to said detected keying line upon at least one of said matrix output lines; and, said matrix output lines connected to said keying lines for driving said keyer circuit.

2. A dynamic one finger chording system as set forth in claim 1 wherein said keying lines receiving said matrix output signal and said keying line corresponding to said depressed key on said keyboard drive said keyer circuit to provide audio frequency range signals representative of a musical chord.

3. A dynamic one finger chording system as set forth in claim 2 wherein said control circuit further comprises counter control logic means having a counter control output line and being responsive to said match signal from said input circuit providing an output signal on said counter control output line for disabling said counter.

4. A dynamic one finger chording system as set forth in claim 3 wherein said input circuit removes said match signal output upon release of said depressed key and said counter control logic means of said control circuit responsive to the removal of said match signal output from said input circuit removes said output signal from said counter control output line and enables said counter.

5. A dynamic one finger chording system as set forth in claim 4 wherein said control means further comprises a pluse generator means for providing a pulse output corresponding to each key depression; and, said counter control logic means responsive to said pulse advances said counter means one address count removing the correspondence between said address count and any previously detected keying line.

6. A dynamic one finger chording system as set forth in claim 5 wherein said input circuit responsive to the lack of correspondence between said address count and said detected keying line removes said match signal output; and, said counter control logic means of said control circuit responsive to the removal of said match signal output from said input circuit removes said output signal from said counter control output line and enables said counter.

7. A dynamic one finger chording system as set forth in claim 6 further comprising:

a buffer circuit receiving said matrix output lines and having a corresponding plurality of output playing lines and providing a plurality of output playing signals in response to said matrix output signal;

said output playing lines connected to said keying lines and said keying lines receiving said output playing signals and said keying line corresponding to said depressed key on said keyboard drive said keyer circuit to provide audio frequency range signals representative of a musical chord;

memory means connected in circuit between said keying lines and said matrix output lines and comprising:

a latch circuit receiving said keying lines and said output playing lines and providing a positive feedback signal to said martrix output lines to sustain said keyer circuits after the instrument player releases said depressed key.

8. A dynamic one finger chording system as set forth in claim 3 wherein said control means further comprises a pulse generator means for providing a pulse output corresponding to each key depression; and, said counter control logic means responsive to said pulse advances said counter means one address count removing the correspondence between said address count and any previously detected keying line.

9. A dynamic one finger chording system as set forth in claim 8 wherein said input circuit responsive to the lack of correspondence between said address count and said detected keying line removes said match signal output; and, said counter control logic means of said control circuit responsive to the removal of said match signal output from said input circuit removes said output signal from said counter control output line and enables said counter.

10. A dynamic one finger chording system as set forth in claim 9 further comprising:

a buffer circuit receiving said martrix output line means and having a corresponding plurality of output playing lines and providing a plurality of output playing signals in response to said matrix output signal;

said output playing lines connected to said keying lines and said keying lines receiving said output playing signals and said keying line corresponding to said depressed key on said keyboard drive said keyer circuit to provide audio frequency range signals representative of a musical chord;

memory means connected in circuit between said keying lines and said matrix output lines and comprising:

a latch circuit receiving said keying line means and said matrix output means and providing a positive feedback signal to said matrix output line means to sustain said keyer circuits after the instrument player releases said depressed key.

11. A dynamic one finger chording system as set forth in claim 2 further comprising a memory means connected in circuit between said keying lines and said matrix output lines for sustaining said keyer circuit after the instrument player releases said depressed key.

12. A dynamic one finger chording system as set forth in claim 11 wherein said memory means comprises a latch circuit receiving said keying lines and said matrix output lines and providing a positive feedback signal to said matrix output lines.

13. A dynamic one finger chording system as set forth in claim 12 wherein said control circuit further comprises a logic circuit responsive to each key depression for disabling said latch circuit and clearing said memory means.

14. An electronic organ having a keyboard, a keyer circuit for providing audio frequency range signals, a plurality of keying lines connecting said keyboard to said keyer circuit and a dynamic one finger chording system connected in parallel to said keying lines and comprising:

an input circuit for receiving a select number of said keying lines and having a match output line;

a scanner circuit having a plurality of address lines connected to said input circuit for continuously addressing said keying lines received by said input circuit for a signal level representing the depression by the instrument player of a corresponding key on said keyboard;

said input circuit providing a match output signal upon detecting said keying line having a signal level representing the depression of a corresponding key on said keyboard;

a control circuit receiving said match output line and having an enable output line and a scanner control output line;

said control circuit in response to said match signal providing an enable output signal on said enable output line and a scanner control output signal on said scanner control line for disabling said scanner;

a matrix having a plurality of matrix output lines and receiving said enable output line and said scanner address lines for providing preprogrammed output signals on at least some of said matrix output lines; and, each of said matrix output lines respectively connected to one of said keying lines for supplying to said keyer circuit said preprogrammed output signals.

15. A dynamic one finger chording system as set forth in claim 14 wherein said keying lines responsive to said programmed output signals from said matrix and said keying line corresponding to said depressed key on said keyboard drive said keyer circuit to provide signals representative of a musical chord.

16. A dynamic one finger chording system as set forth in claim 15 wherein said control means further comprises a pluse generator means for providing a pulse output corresponding to each key depression; and, said scanner means responsive to said pulse output for advancing one address removing the correspondence between said address and any previously detected keying line.

17. A dynamic one finger chording system as set forth in claim 16 wherein said input circuit responsive to the lack of correspondence between said scanner address and said detected keying line removes said match signal output; and said control circuit responsive to the removal of said match signal output from said input circuit enables said counter.

18. A dynamic one finger chording system as set forth in claim 17 wherein said input circuit removes said match signal output upon release of said depressed key; and, said control circuit responsive to the absence of said match signal output from said input circuit enables said scanner.

19. A dynamic one finger chording system as set forth in claim 18 further comprising:

a buffer circuit receiving said matrix output lines and having a corresponding plurality of output playing lines and providing a plurality of output playing signals in response to said matrix output signal;

said output playing lines connected to said keying lines and said keying lines receiving said output playing signals and said keying line corresponding to said depressed key on said keyboard drive said keyer circuit to provide audio frequency range signals representative of a musical chord;

memory means connected in circuit between said keying lines and said matrix output lines and comprising:

a latch circuit receiving said keying lines and said output playing lines and providing a positive feedback signal to said matrix output lines to sustain said keyer circuits after the instrument player releases said depressed key.

20. An electronic organ having a keyboard, a keyer circuit for providing audio frequency range signals, a plurality of keying lines connecting said keyboard to said keyer circuit and a dynamic one finger chording system connected in parallel to at least some of said keying lines and comprising:

an input circuit receiving at least some of said keying lines and having a match output line;

continuously sequencing counter means having a plurality of address lines connected to said input circuit for scanning said received keying lines for a signal representing the depression of a corresponding key on said keyboard by an instrument player;

said input circuit providing a match signal upon said match output line when said keying line having a signal representing the depression of a corresponding key on said keyboard is detected by said counter means;

a control circuit receiving said match output line and having an enable output line and providing an enable signal in response to said match signal;

a matrix for receiving said enable output line from said control circuit and said address lines from said counter and having at least one matrix output line and providing a matrix output signal related to said detected keying line upon at least one of said matrix output lines;

a buffer circuit receiving said matrix output lines and having a corresponding plurality of output playing lines and providing a plurality of output playing signals in response to said matrix outut signal;

said output playing lines connected to said keying lines and said keying lines receiving said output playing signals and said keying line corresponding to said depressed key on said keyboard drive said keyer circuit to provide audio frequency range signals representative of a musical chord;

memory means connected in circuit between said keying lines and said matrix output lines and comprising:

a latch circuit receiving said keying lines and said output playing lines and providing a positive feedback signal to said matrix output lines to sustain said keyer circuit after the instrument player releases said depressed key.

21. A dynamic one finger chording system as set forth in claim 20 wherein said control circuit further comprises a logic circuit responsive to each key depression for disabling said latch circuit and clearing said memory mens.

22. A dynamic one finger chording system for use in an electronic musical instrument having a keyboard for providing a keying signal upon the depression of a key, a keyer circuit for receiving said keying signal and providing audio frequency range signals, a keying line means for connecting said keyboard to said keyer circuit and for transmitting said keying signal from said keyboard to said keyer circuit, said dynamic one finger chording system connected in parallel to said keying line means and comprising:

an input circuit receiving said keying line means and having a match output line;

continuously sequencing counter means having a plurality of address lines connected to said input circuit for scanning said received keying line means for a keying signal;

said input circuit providing a match signal upon said match output line when said keying signal is detected by said counter means;

a control circuit receiving said match output line and having an enable output line for providing an enable signal in response to said match signal;

a matrix receiving said enable output line from said control circuit and said address lines from said counter and having a matrix output line means and providing a matrix output signal related to said detected keying signal upon said matrix output line means; and said matrix output line means connected to said keying line means for driving said keyer circuit.

23. A dynamic one finger chording system as set forth in claim 22 wherein said control circuit further comprises counter control logic means having a counter control output line and being responsive to said match signal from said input circuit and providing an output signal on said counter control output line for disabling said counter.

24. A dynamic one finger chording system as set forth in claim 23 wherein said control means further comprises a pulse generator means for providing a pulse output corresponding to each key depression; and, said counter control logic means responsive to said pulse advances said counter means one address count removing the correspondence between said address count and any previously detected keying signal.

25. A dynamic one finger chording system as set forth in claim 24 wherein said input circuit responsive to the lack of correspondence between said address count and said detected keying signal removes said match signal output; and, said counter control logic means of said control circuit responsive to the removal of said match signal output from said input circuit removes said output signal from said counter control output line and enables said counter.

26. A dynamic one finger chording system as set forth in claim 25 wherein said input circuit removes said match signal output upon release of said depressed key; and said counter control logic means of said control circuit responsive to the removal of said match signal output from said input circuit removes said output signal from said counter control output line and enables said counter.

27. A dynamic one finger chording system as set forth in claim 26 wherein said keying line means receiving said matrix output signal and said keying line means corresponding to said depressed key on said keyboard drive said keyer circuit to provide audio frequency range signals representative of a musical chord.

28. A dynamic one finger chording system as set forth in claim 27 further comprising a memory means connected in circuit between said keying line means and said matrix output line means for sustaining said keyer circuit after the instrument player releases said depressed key.

29. A dynamic one finger chording system as set forth in claim 28 wherein said memory means comprises a latch circuit receiving said keying line means and said matrix output line means and providing a positive feedback signal to said matrix output line means.

30. A dynamic one finger chording system as set forth in claim 29 wherein said control circuit further comprises a logic circuit responsive to each key depression for disabling said latch circuit and clearing said memory means.

31. A dynamic one finger chording system for use in an electronic musical instrument having a keyboard, a keyer circuit for providing audio frequency range signals, a plurality of keying lines connecting said keyboard to said keyer circuit and said dynamic one finger chording system connected in parallel to at least some of said keying lines and comprising:

an input circuit receiving at least some of said keying lines and having a match output line;

continuously sequencing counter means having a plurality of address lines connected to said input circuit for scanning said received keying lines for a signal representing the depression of a corresponding key on said keyboard by an instrument player;

said input circuit providing a match signal upon said match output line when said keying line having a signal representing the depression of a corresponding key on said keyboard is detected by said counter means;

a control circuit receiving said match output line and having an enable output line for providing an enable signal in response to said match signal;

a matrix receiving said enable output line from said control circuit and said address lines from said counter and having a plurality of matrix output lines and providing a matrix output signal related to said detected keying line upon at least one of said matrix output lines;

said matrix output lines connected to said keying lines for driving said keyer circuit; and, a memory means connected in circuit between said keying lines and said matrix output lines for sustaining said keyer circuit after the instrument player releases said depressed key.

32. A dynamic one finger chording system as set forth in claim 31 wherein said memory means comprises a latch circuit receiving said keying lines and said matrix output lines and providing a positive feedback signal to said matrix output lines.

33. A dynamic one finger chording system as set forth in claim 32 wherein said control circuit further comprises a logic circuit responsive to each key depression for disabling said latch circuit and clearing said memory means.

34. A dynamic one finger chording system for use in an electronic musical instrument having a keyboard for providing a keying signal upon the depression of a key, a keyer circuit for receiving said keying signal and providing audio frequency range signals, a keying line means for connecting said keyboard to said keyer circuit and for transmitting said keying signal from said keyboard to said keyer circuit, said dynamic one finger chording system connected in parallel to said keying line means and comprising:

an input circuit receiving said keying line means and having a match output line;

continuously sequencing counter means having a plurality of address lines connected to said input circuit for scanning said received keying line means for a keying signal;

said input circuit providing a match signal upon said match output line when said keying signal is detected by said counter means;

a control circuit receiving said match output line and having an enable output line for providing an enable signal in response to said match signal;

a matrix receiving said enable input line from said control circuit and said address lines from said counter and having a matrix output line means and providing a matrix output signal related to said detected keying signal upon said matrix output line means;

said matrix output line means connected to said keying line means for driving said keyer circuit; and, a memory means connected in circuit between said keying line means and said matrix output line means for sustaining said keyer circuit after the instrument player releases said depressed key.

35. A dynamic one finger chording system as set forth in claim 34 wherein said memory means comprises a latch circuit receiving said keying line means and said matrix output line means and providing a positive feedback signal to said matrix output line means.

36. A dynamic one finger chording system as set forth in claim 35 wherein said control circuit further comprises a logic circuit responsive to each key depression for disabling said latch circuit and clearing said memory means.

* * * * *